US009782735B2

(12) United States Patent
Ortiz Garcia

(10) Patent No.: US 9,782,735 B2
(45) Date of Patent: Oct. 10, 2017

(54) DEVICE FOR MIXING AND APPLYING A COMPOUND PRODUCED BY MIXING TWO PRODUCTS

(71) Applicant: Daniel Ortiz Garcia, Valencia (ES)

(72) Inventor: Daniel Ortiz Garcia, Valencia (ES)

( * ) Notice: Subject to any disclaimer, the term of this patent is extended or adjusted under 35 U.S.C. 154(b) by 0 days.

(21) Appl. No.: 14/898,137

(22) PCT Filed: Jun. 12, 2013

(86) PCT No.: PCT/ES2013/070379

§ 371 (c)(1),
(2) Date: Dec. 13, 2015

(87) PCT Pub. No.: WO2014/198966

PCT Pub. Date: Dec. 18, 2014

(65) Prior Publication Data

US 2016/0136599 A1 May 19, 2016

(51) Int. Cl.
*B01F 13/00* (2006.01)
*B05C 17/005* (2006.01)
(Continued)

(52) U.S. Cl.
CPC ..... *B01F 13/0027* (2013.01); *B01F 9/02* (2013.01); *B01F 15/027* (2013.01);
(Continued)

(58) Field of Classification Search
CPC ..... B01F 13/0027; B01F 9/02; B01F 15/027; B01F 15/0278; B05C 17/00553; B05C 17/01
See application file for complete search history.

(56) References Cited

U.S. PATENT DOCUMENTS 4,260,076 A 4/1981 Bergman
4,669,636 A 6/1987 Miyata
(Continued)

OTHER PUBLICATIONS

International Search Report dated Apr. 8, 2014 issued in PCT/ES2013/070379, which the present application is a national phase filing of.

*Primary Examiner* — Frederick C Nicolas
(74) *Attorney, Agent, or Firm* — Porzio Bromberg Newman P.C.

(57) ABSTRACT

The present invention relates to a mixer and applicator device for mixing and applying a compound obtained by means of mixing two products which comprises: a casing which internally houses a movable push rod, where the casing allows housing a container which is fixed to the casing, a drill or rotor for driving the movable push rod, a base part coupled to a rear portion of the drill or rotor, at least one guide which is secured at a first end on the base part and at a second end on the casing where the ends of the at least one guide are fixed on the casing such that the at least one guide allows the fixing and rotation of the casing, and at least one member going through the at least one guide respectively such that the rotation of the casing does not take place in response to the actuation of the drill or rotor. As a result of this device it is possible, using the same device, to prepare a compound by means of mixing a base product and a catalyst and to further be able to dispense it without having to perform any disassembly or adaptation whatsoever in the container or in the means used for the mixing.

11 Claims, 6 Drawing Sheets

(51) Int. Cl.
*B05C 17/01* (2006.01)
*B01F 9/02* (2006.01)
*B01F 15/02* (2006.01)

(52) U.S. Cl.
CPC .... *B01F 15/0278* (2013.01); *B05C 17/00553* (2013.01); *B05C 17/01* (2013.01)

(56) References Cited

U.S. PATENT DOCUMENTS 5,161,715 A * 11/1992 Giannuzzi ..... B05C 17/00506 222/105
5,211,312 A 5/1993 Chang
5,839,612 A * 11/1998 Burke ..... B05C 17/0103 222/333
5,993,188 A * 11/1999 Mak ..... A47J 19/005 222/390
6,041,976 A 3/2000 Robertson
7,811,074 B2 * 10/2010 Schnee ..... A21C 15/005 425/183
2009/0291158 A1 11/2009 Schnee

* cited by examiner

DEVICE FOR MIXING AND APPLYING A COMPOUND PRODUCED BY MIXING TWO PRODUCTS

OBJECT OF THE INVENTION

As established in the title, the object of the present invention is a mixer and applicator device for mixing and applying a compound obtained by means of mixing two products, and it can also be used only as an applicator device.

The present invention is characterized by the special constructive features of the device such that the device can be used both for mixing the base substance with a catalyst and for applying the obtained compound, all this without having to make significant structural modifications in the device.

Therefore, the present invention is comprised within the field of devices used for obtaining compounds by means mixing a base product with a catalyst, and it is also comprised within the field of applicator means for applying said compounds.

BACKGROUND OF THE INVENTION

Catalysis is the process whereby the rate of a chemical reaction is increased due to the participation of a substance called a catalyst.

Many industrial processes involve catalysis. Similarly, most "biologically" significant processes are catalyzed. Research in catalysis is a major field in applied science and involves many areas of chemistry, particularly in organometallic chemistry and materials science. Catalysis is important for many aspects of environmental science, e.g. the catalytic converter in automobiles and the dynamics of the ozone hole. Catalytic reactions are preferred in environmentally friendly green chemistry due to the reduced amount of waste generated, as opposed to stoichiometric reactions in which all reactants are consumed and more byproducts are formed.

In the aeronautics industry, a compound is used for sealing the airplane fuselage. This compound is obtained by means of mixing two products, one of them being a catalyst that must be suitably mixed with the base product. The two substances must be mixed in suitable proportions so that they react with one another before application and so that the obtained compound subsequently hardens once it is applied on the joint or surface.

Said compound is obtained from a kit having two elements, one of which is a container containing the base product or sealant, whereas the other is a plunger which can penetrate the sealant container and which contains a catalyst.

To enable adding and mixing the catalyst inside the sealing container, a specific machine is used which allows introducing the plunger into the container with a linear movement, while at the same time the sealing container is subjected to a rotary movement, completing a cycle of 60 to 75 times so that the mixture is homogenous.

Once the base product and the catalyst are mixed, the plunger containing the catalyst is removed, the mixture remaining inside the container, ready to be applied.

To apply the compound resulting from the mixing performed, a cannula which allows applying the sealant in the form of a bead inside the groove or joint is screwed on the mouth of the container.

To perform the application process, it is necessary to push the rear inner portion of the container using a gun that works with compressed air such that it moves the movable inner portion of the container, making the compound exit through the nozzle.

Therefore, a mixing device or machine tool is used for obtaining the mixture, whereas a different machine is used for application, a condition which complicates and makes the process difficult given the large number of containers used in sealing the aircraft joints.

Therefore, the object of the present invention is to develop a device which simplifies and reduces the means necessary for obtaining the mixture and performing the subsequent application of a compound, developing a device such as the one described below the essential features of which are shown in claim 1.

Disclosure of the Invention

The object of the present invention is a mixer and/or applicator device for mixing and/or applying a compound obtained by means of mixing two products, it is a single device which allows both mixing the two products, a base product and a catalyst product, and the device subsequently can also be used for applying the obtained compound, the device also being able to be used only as an applicator device.

The device comprises:

- a casing which internally houses a movable push rod and which allows housing a container containing the base product or sealant, the container being fixed to the casing by fixing means,
- driving means for driving the movable push rod housed inside the casing, fitting and fixing means for fitting and fixing the driving means,
- rotation blocking or release means for blocking or releasing the rotation of the casing.

In a possible embodiment, the driving means for driving the push rod are a drill or similar rotation means.

The movable push rod comprises:

- a termination for anchoring and fixing on the nozzle of the drill,
- a threaded rod,
- a transmission or blocking part which is internally threaded and on which the threaded rod is screwed,
- and the push head integrally fixed on the transmission or blocking part.

The fitting and fixing means for fitting and fixing the driving means comprise:

- fitting and pressing means at the rear portion of the driving means or drill,
- guides, which can be telescopic guides, in order to enable regulating the free space between the fitting and pressing means at the rear portion of the drill and the base of the casing, The guides are secured at one end on the fitting and pressing means of the rear portion of the drill and on the other hand on the casing. The ends of the guides will be fixed on the casing such that they allow the rotation of the casing, for which there is arranged on the casing a bearing, and on the latter a flange or similar means on which the ends of the guides are fixed.

In a possible embodiment, the anchoring and release means for anchoring and releasing the rotation of the casing can be rods or anchorings passing through the guides, being housed in rings or the like fixed in the base of the casing.

When what is first sought is to obtain the sealing compound by means of mixing the two products, the rotation blocking means for blocking the rotation of the casing are released, i.e., the rotation of the casing is allowed, such that upon actuating the drill, the rotation of the casing and the container takes place, pressure is exerted on the plunger manually on the other hand which introduces the catalyst into the container, the rotation of the container and pressing on the plunger causing the uniform mixing of the compound.

When the compound has already been obtained, removing the plunger and arranging a metering cannula or nozzle is sufficient for the application thereof on the joints where the compound is to be applied, further proceeding to block the rotation of the casing for which purpose, as previously mentioned, rods are passed through the guides, being housed at the ends of the guides.

Therefore, when the drill or the like is actuated and in response to the impossibility of rotating the casing, when changing the direction of the rotation of the drill, rotates freely and since it is threaded onto the locking and transmission piece which is housed on the coupling part, the threaded rod moves through the transmission or blocking part causing the push head to move forward pressing on the base to dispense a product from the container.

Therefore, when the device is to be used as a mixer and applicator device, the rotation blocking means for blocking the rotation of the casing can be assembled or released, working as a mixer when the rotation blocking means for blocking the rotation of the casing are not assembled, and working as an applicator when the rotation means are activated or assembled. If the device is only to be required to work as an applicator, the rotation blocking means for blocking the rotation of the casing do not have to be releasable or removable, rather the casing can be blocked permanently.

Therefore, as a result of the aforementioned means, the assembly and interconnection thereof, a device which can be used both for the functions of mixing the products of the compound and/or for applying same is obtained without having to perform any disassembly or adaptation whatsoever in the container or in the means used for mixing, which results in a considerable simplification of the means and times used in both actions.

DESCRIPTION OF THE DRAWINGS

To complement the description that is being made and for the purpose of better understanding the features of the invention according to a preferred practical embodiment thereof, a set of drawings is attached as an integral part of said description in which the following has been depicted with an illustrative and non-limiting character.

PREFERRED EMBODIMENT OF THE INVENTION

The preferred embodiment of the proposed invention is described below in view of the drawings.

Figure 1:
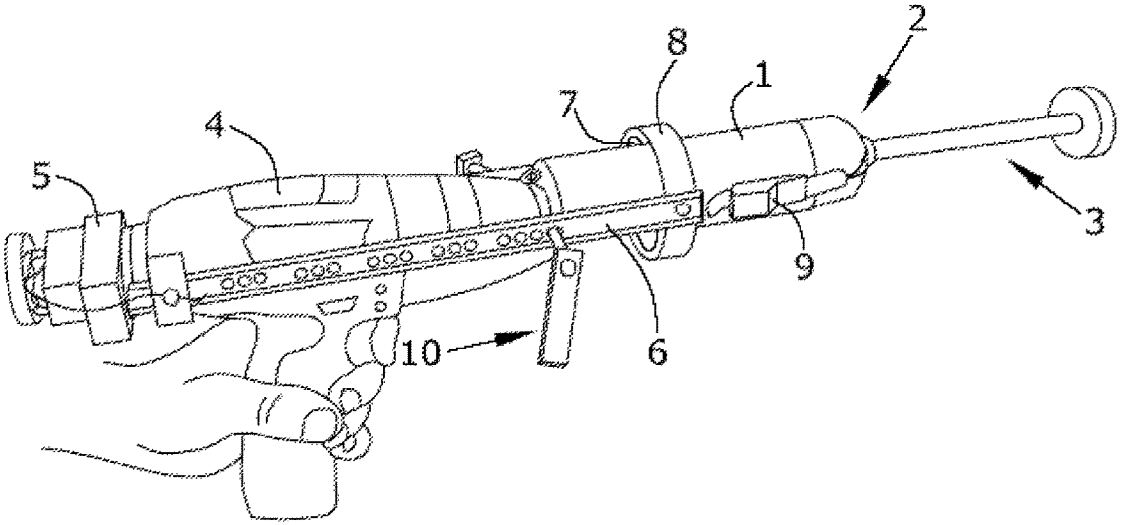
FIG. 1 shows a general depiction of the device assembled with a container and with the plunger, prepared for mixing.

FIG. 1 shows the device object of the invention comprising:

- a casing (1) which internally houses a movable push rod (13) (FIG. 5) and which allows housing a container (2) containing the base product or sealant, and on which a plunger (3) containing a catalyst product is arranged, the container being fixed to the casing by fixing means (9), making the container (2) integral with the casing (1),
- driving means for driving the movable push rod housed inside the casing, which is a drill (4) in this case,
- fitting and fixing means for fitting and fixing the driving means,
- rotation blocking or release means for blocking or releasing the rotation of the casing.

The fitting and fixing means for fitting and fixing the driving means comprise:

- fitting and pressing means (5) at the rear portion of the driving means or drill (4),
- guides (6) which could be telescopic guides.

As a result of the diameter of the casing which is slightly greater than the outer diameter of the container and of the fixing means (9) for fixing the container (2) on the casing (1), the container (2) can be easily replaced and removed once the sealing substance of the container (2) has been used up in order to introduce another new container (2) into the casing (1) of the mixer and applicator device without needing to modify the container in any way whatsoever.

The guides (6) are secured at one end on the fitting and pressing means (5) of the rear portion of the drill and on the other hand on the casing. The ends of the guides will be fixed on the casing such that they allow the rotation of the casing, for which there is arranged on the casing a bearing (7), and on the latter a flange (8) or similar means on which the ends of the guides are fixed.

Figure 2:
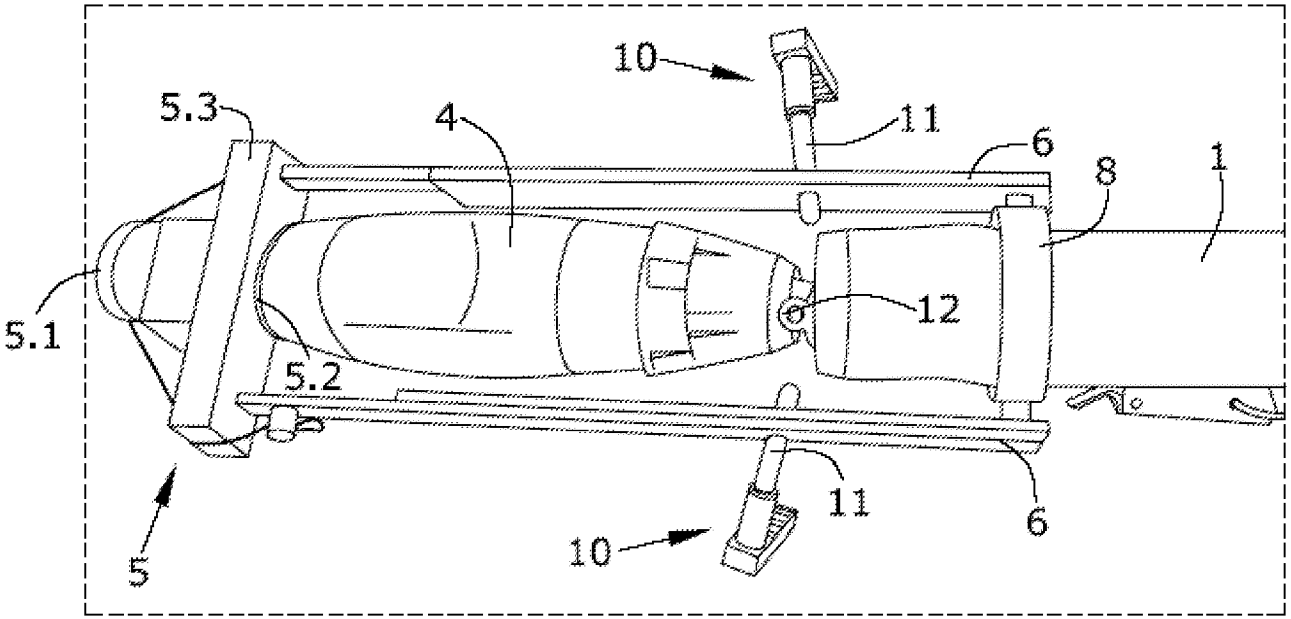
FIG. 2 shows part of the device in detail.

FIG. 2 shows some additional details of the fitting and pressing means (5) which comprise:

- a base part (5.3) on which the ends of the guides are fixed,
- a movable part (5.2) pushing and pressing on the rear portion of the drill,
- an actuating control knob (5.1) which by means of a threaded rod, not depicted and attached at one of its ends to the control (5.1), moves the movable part (5.2) forward or backward.

It must be pointed out that as can be observed, the rotation blocking means (10) for blocking the rotation of the casing as depicted in a possible embodiment, could consist of pins (11) going through the guides, being housed in rings (12) or washers, such that when they are arranged in this manner the rotation of the casing does not take place in response to the actuation of the drill (4).

Figure 3:
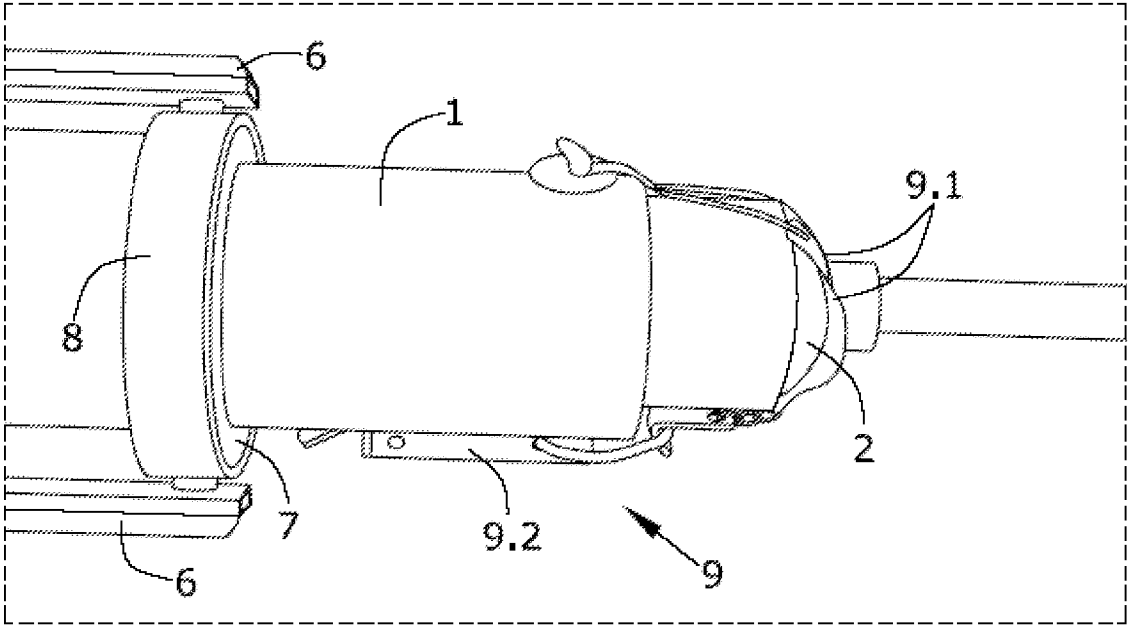
FIG. 3 shows the attachment between the ends of the guide with the casing in detail.

FIG. 3 shows the fixing means for fixing the container (2) on the casing (1) which could consists of two crescent-shaped structures (9.1) surrounding the emerging end of the container, being fixed at one of their ends directly on the casing (1) and at the other end on a closure clip (9.2), fixed to the casing (1).

On the other hand, to allow securing the rotation of the casing (1) with respect to the ends of the guides (6), the securing takes place by means of a bearing (7) or a similar element, on which a flange or clamp (8) is arranged, such that when the rotation blocking means (10) are not arranged, the rotation of the casing (1) takes place upon actuating the drill, a condition that occurs when the compound is to be prepared by means of mixing the components.

Figure 4:
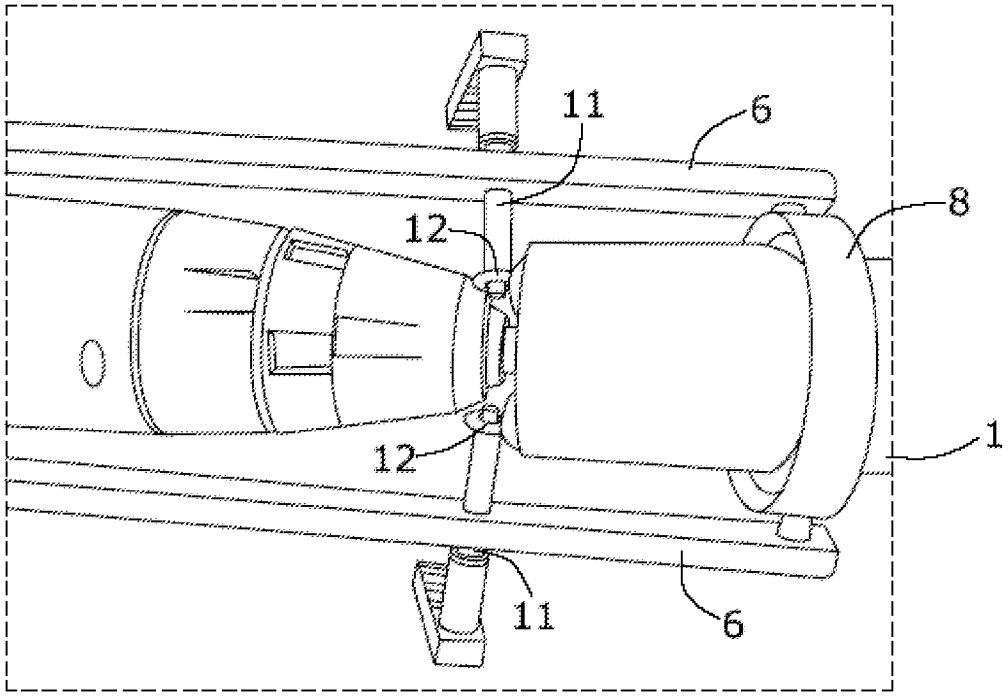
FIG. 4 shows in detail how the blocking of the rotation of the casing takes place.

FIG. 4 shows in detail how the rotation blocking means (10) are assembled, which prevents the transmission of the rotation of the drill (4) to the casing, so only the rotation of a threaded rod (14) takes place.

Figure 5:
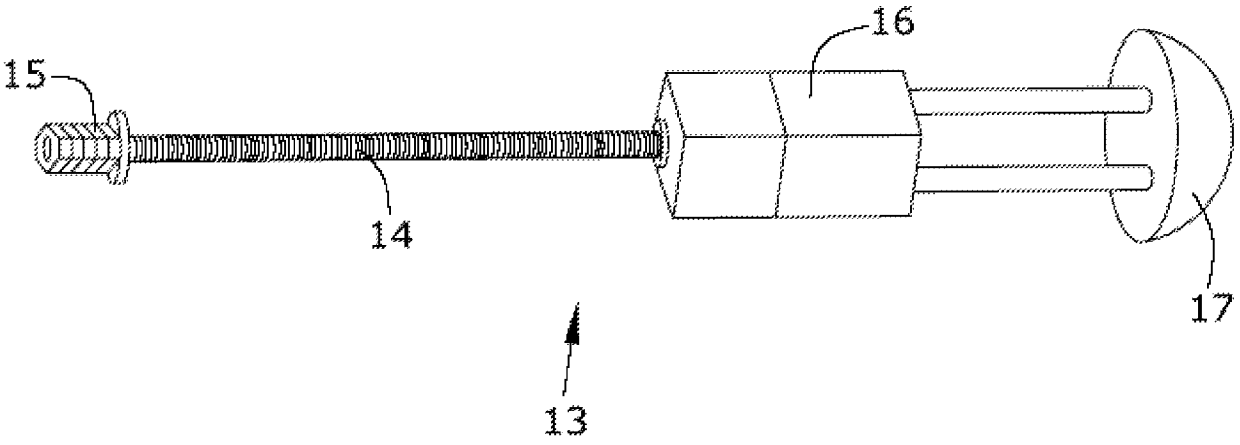
FIG. 5 shows the push rod housed inside the casing.
Figure 6:
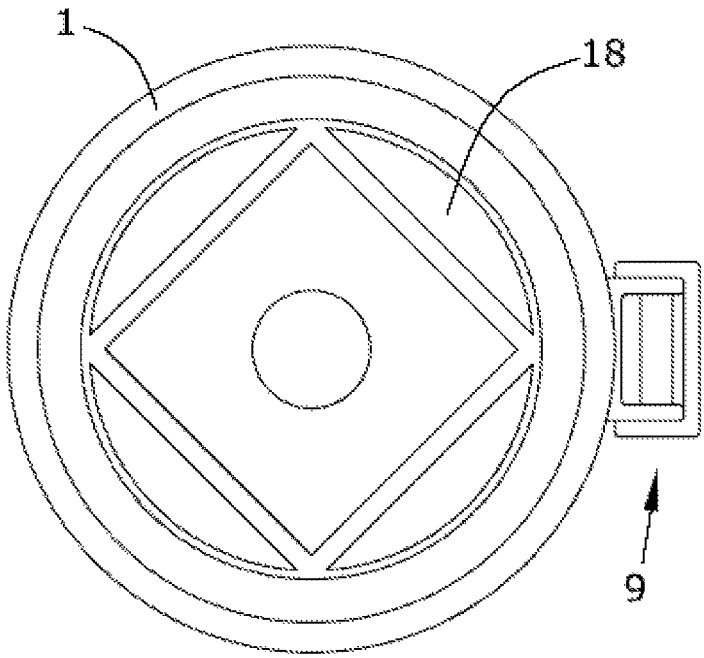
FIG. 6 shows the inside of the casing where the push rod is housed.

FIGS. 5 and 6 show both the push rod and the complementary means housed inside the casing (1) which allow transmitting the rotation of the drill (4) .

FIG. 5 shows the movable push rod (13) comprising:

a termination (15) for anchoring and fixing on the nozzle of the drill (4), a threaded rod (14), a transmission or blocking part (16) which is internally threaded and on which the threaded rod is screwed, and the push head (17) integrally fixed on the transmission or blocking part.

FIG. 6 shows that at the bottom of the casing (1) there is housed a coupling part (18) having a hollow section equal to the cross section of the transmission or blocking part (16), such that when the rotation blocking means (10) are not actuated it rotates the casing, and when the rotating blocking means (10) are actuated, in response to the impediment of the rotation of the casing and as a result in a direction of rotation of the drill with the transmission and lock piece (16) fully retracted, rotates the housing and the container (2) for mixing and when the rotation direction of the drill is changed and casing (1) is locked the pusher mechanism is activated to press and dose the compound , metering the compound contained therein.

Coupling part 18 has dimensions and geometry such that it transmits both a rotational movement to the container (2) and a translational movement to the moving base.

Having sufficiently described the nature of the present invention as well as the manner of putting it into practice, it must be stated that it could be carried out to practice within its essential features in other embodiments differing in detail from that indicated by way of example, and such embodiments will also achieve the protection sought provided that the fundamental principle thereof is neither altered, changed nor modified.

The invention claimed is:

1. A mixer and applicator device for mixing and applying a compound obtained by mixing of two products, comprising:

a casing which internally houses a movable push rod, the movable push rod including a threaded rod and a transmission or blocking part, the threaded transmission or blocking part is threaded on the threaded rod, where the casing allows housing a container which is fixed to the casing, a drill or rotor for driving the movable push rod housed inside the casing, a base part coupled to a rear portion of the drill or rotor, at least one guide which is secured at a first end on the base part and at a second end on the casing where the ends of the at least one guide are fixed on the casing such that the at least one guide allows the fixing and rotation of the casing, and at least one member going through the at least one guide respectively such that the rotation of the casing does not take place in response to the actuation of the drill or rotor.

2. The mixer and applicator device for mixing and applying a compound obtained by mixing of two products according to claim 1, further comprising:

a movable part pushing and pressing on the rear portion of the drill, an actuating control knob attached to one end of the threaded rod, the actuating control knob moves the movable part forward or backward.

3. The mixer and applicator device for mixing and applying a compound obtained by mixing of two products according to claim 1, wherein the ends of the at least one guide are fixed on the casing with a bearing.

4. The mixer and applicator device for mixing and applying a compound obtained by mixing of two products according to claim 1, further comprising two crescent-shaped structures being fixed at a first end directly on the casing and at a second end on a closure clip fixed to the casing.

5. The mixer and applicator device for mixing and applying a compound obtained by mixing of two products according to claim 1, wherein in a bottom of the casing there is housed a coupling part having a hollow section equal to the cross section of the transmission or blocking part, the threaded rod moves through the transmission or blocking part causing the push head to move forwarding pressing on the base to dispense a product from the container.

6. The mixer and applicator device for mixing and applying a compound obtained by mixing of two products according to claim 5, wherein the coupling part has dimensions and geometry to transmit both a rotational movement to the container and a translational movement to the moving base part.

7. The mixer and applicator device for mixing and applying a compound obtained by mixing of two products according to claim 1, wherein the at least one guides are telescopic guides.

8. The mixer and applicator device for mixing and applying a compound obtained by mixing of two products according to claim 1 wherein a diameter of the casing is slightly greater than a diameter of the container.

9. An applicator device for applying a compound obtained by mixing of two products, comprising:

a casing which internally houses a movable push rod, the movable push rod including a threaded rod and a transmission or blocking part, the threaded transmission or blocking part is threaded on the threaded rod, where the casing allows housing a container which is fixed to the casing, a drill or rotor for driving the movable push rod housed inside the casing, a base part coupled to a rear portion of the drill or rotor, at least guide which is secured at a first end on the base part and at a second end on the casing where the ends of the at least one guide are fixed on the casing such that the at least one guide allows the fixing and rotation of the casing, and at least one member going through the at least one guide respectively such that the rotation of the casing does not take place in response to the actuation of the drill or rotor, the at least one member is a pin.

10. The mixer and applicator device for mixing and applying a compound obtained by mixing of two products according to claim 9, an end of the pin going through at least one guide is received in a ring or washer of said casing.

11. The mixer and applicator device for mixing and applying a compound obtained by mixing of two products according to claim 10 wherein the ends of the at least one guide are fixed on the casing with a bearing arranged on a flange or clamp.

* * * * *